US006554000B2

(12) United States Patent
Lin

(10) Patent No.: US 6,554,000 B2
(45) Date of Patent: Apr. 29, 2003

(54) HAND-HELD HAIR-CURLING APPLIANCE WITH DEVIATION PREVENTION DURING USE

(76) Inventor: Hwai-Tay Lin, Akara Building, 24 De Castro Street, Wickhams Cay I, Road Town, Tortola (VG)

( * ) Notice: Subject to any disclaimer, the term of this patent is extended or adjusted under 35 U.S.C. 154(b) by 0 days.

(21) Appl. No.: 09/961,582

(22) Filed: Sep. 24, 2001

(65) Prior Publication Data

US 2003/0056803 A1 Mar. 27, 2003

(51) Int. Cl.[7] ..... A45D 1/04; A45D 6/02
(52) U.S. Cl. ..... 132/232; 132/229; 132/237
(58) Field of Search ..... 132/232, 233, 132/234, 223, 224, 226, 229, 269, 237

(56) References Cited

U.S. PATENT DOCUMENTS 3,805,811 A * 4/1974 Dorn ..... 132/232
4,192,328 A * 3/1980 Barradas et al. ..... 132/232
4,695,704 A * 9/1987 Andis ..... 219/222
4,939,340 A * 7/1990 Brill ..... 219/225
4,953,574 A * 9/1990 Tsuji et al. ..... 132/232
5,120,933 A * 6/1992 Altamore et al. ..... 219/225
5,400,810 A * 3/1995 Taylor ..... 132/232
6,047,707 A * 4/2000 Johnson ..... 132/232

* cited by examiner

*Primary Examiner*—John J. Wilson
*Assistant Examiner*—Robyn Kieu Doan
(74) *Attorney, Agent, or Firm*—Alan D. Kamrath; Rider, Bennett, Egan & Arundel

(57) ABSTRACT

A hair-curling appliance has a first end and a second end that is rotatably connected to the first end. When the operator moves the hair-curling appliance downward, the first end of the appliance held by an end of an operator is turned to curl the hair of another person, and the second end of the appliance held by the other hand of the operator is not turned during the downward travel of the appliance, thereby keeping a longitudinal axis of the appliance parallel to a horizontal axis and thus preventing deviation of the appliance. A satisfactory hair-curling result is thus obtained.

15 Claims, 9 Drawing Sheets

4 – 4

HAND-HELD HAIR-CURLING APPLIANCE WITH DEVIATION PREVENTION DURING USE

BACKGROUND OF THE INVENTION

1. Field of the Invention

The present invention relates to a hand-held hair-curling appliance of the type that is turned during use so as to curl hair manually. In particular, the present invention relates to a hand-held hair-curling appliance in which deviation thereof is prevented during use to thereby obtain a satisfactory hairstyle.

2. Description of the Related Art

A typical conventional hand-held hair-curling appliance requires the operator to use both hands to respectively hold two ends of the appliance that has clamped the hair of another person and then roll the appliance downward to curl the hair. However, it is difficult for the operator to keep the longitudinal axis of the appliance parallel to a horizontal axis during the rolling, which results in deviation of the appliance. The hair-curling result is thus poor, as the resultant hair has no uniform thickness and is asymmetric and in a mass. In addition to wasting time, re-curling harms the hair again.

SUMMARY OF THE INVENTION

An object of the present invention is to provide a hand-held hair-curling appliance in which deviation during the rolling thereof can be eliminated. The hair-curling appliance has a first end and a second end that is rotatably connected to the first end. When the operator moves the hair-curling appliance downward, the first end of the appliance held by an end of an operator is turned to curl the hair of another person, and the second end of the appliance held by the other hand of the operator is not turned during the downward travel of the appliance, thereby keeping a longitudinal axis of the appliance parallel to a horizontal axis and thus preventing deviation of the appliance. A satisfactory hair-curling result is thus obtained.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
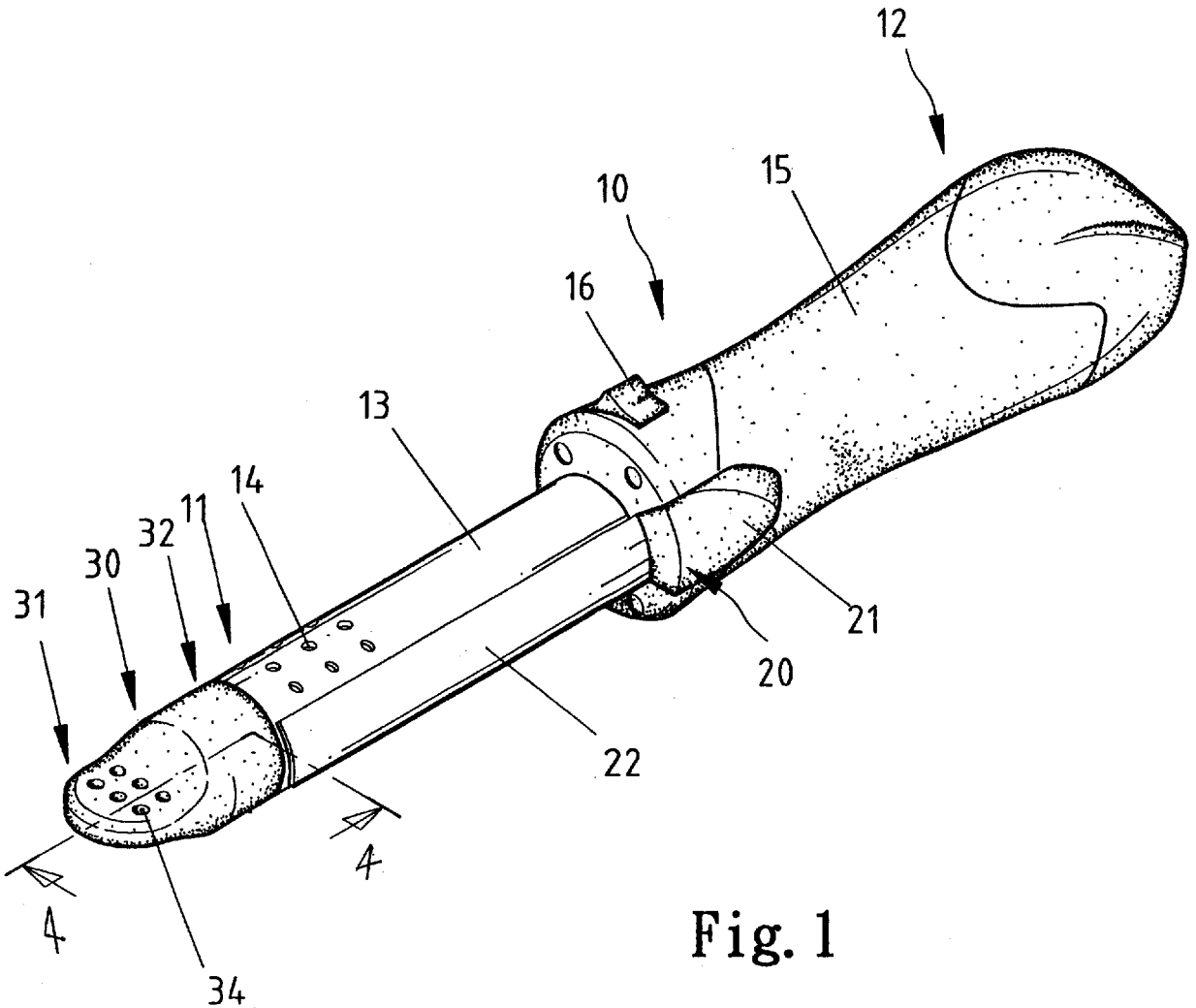
FIG. 1 is a perspective view of a hand-held hair-curling appliance in accordance with the present invention.
Figure 2:
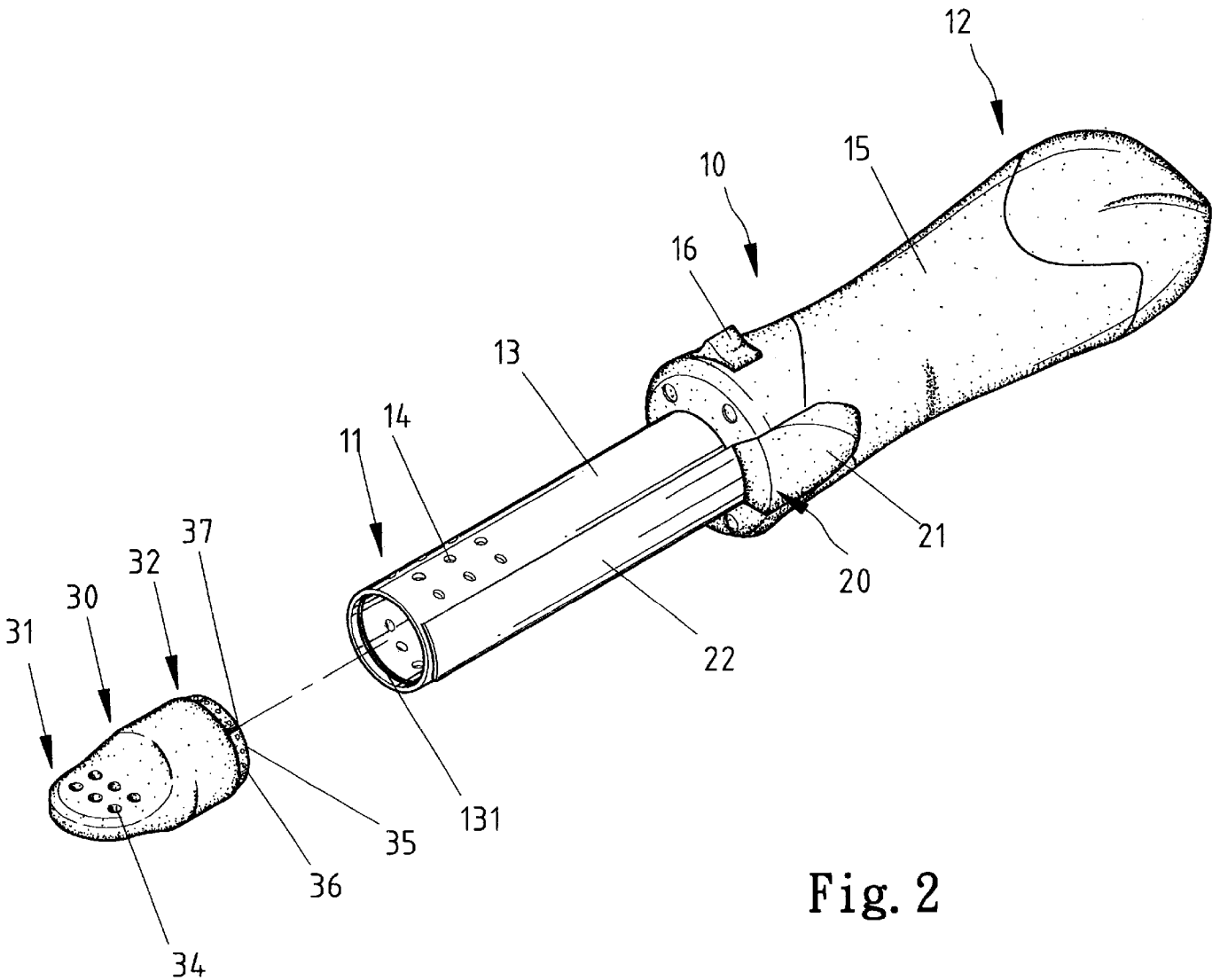
FIG. 2 is a perspective view, partly exploded, of the hand-held hair-curling appliance in accordance with the present invention.

Referring to FIGS. 1 and 2, a hand-held hair-curling appliance in accordance with the present invention generally comprises a heater 10 having a first end 11 and a second end 12. A heat-transmitting portion 13 is provided on the first end 11 of the heater 10 and made of material that has a high heat conducting efficiency. Plural holes 14 may be formed on the heat-transmitting portion 13 to improve the heat conducting efficiency. Formed on the second end 12 of the heater 10 is a grip portion 15 that is preferably configured ergonomically for easy, comfortable grip by an operator. A heating means (not shown), such as an electric heating means, gas-burning means, etc., is mounted inside the grip portion 15 for heating the heat-transmitting portion 13. An on/off switch 16 is mounted on the grip portion 15 to control on/off of the heating means. In addition, the heat-transmitting portion 13 includes an annular engaging groove 131 in an end that is distal to the grip portion 15.

Figure 3:
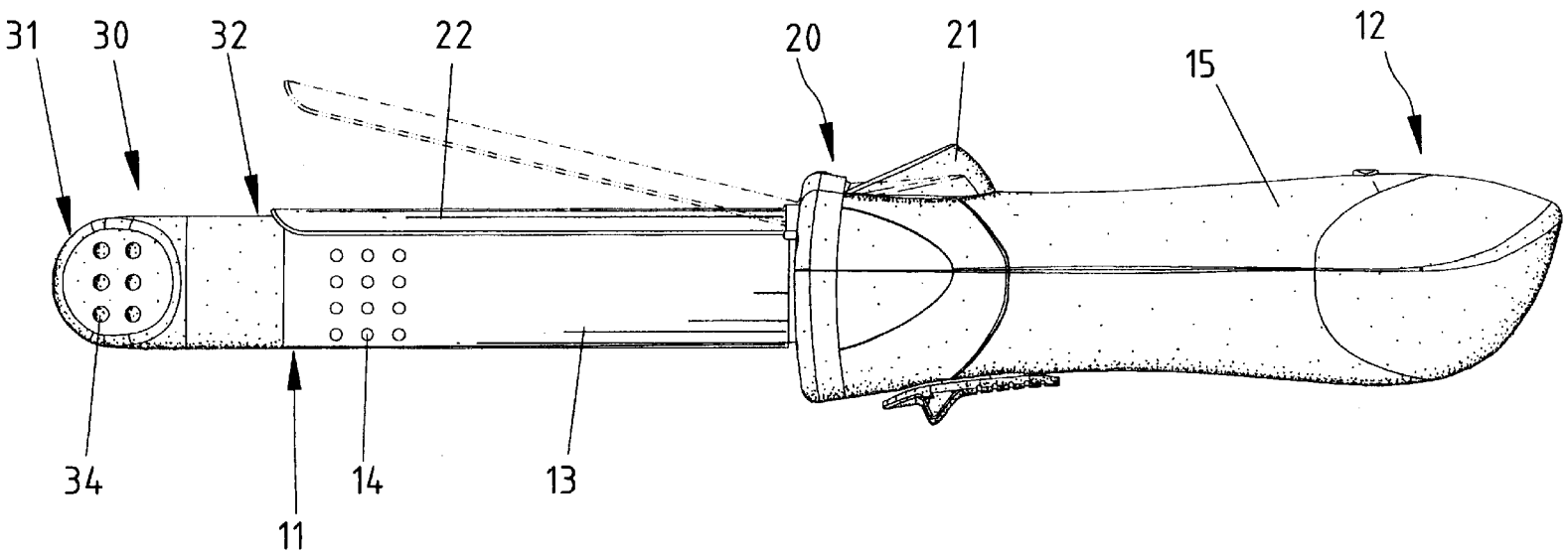
FIG. 3 is a side view of the hand-held hair-curling appliance.

A hair-clamping member 20 is pivotally mounted to the grip 15 at an intermediate portion thereof such that pressing of an end 21 of the hair-clamping member 20 causes the other end 22 of the hair-clamping member 20 to move away from the heat-transmitting portion 13, best shown in FIG. 3.

Figure 4B:
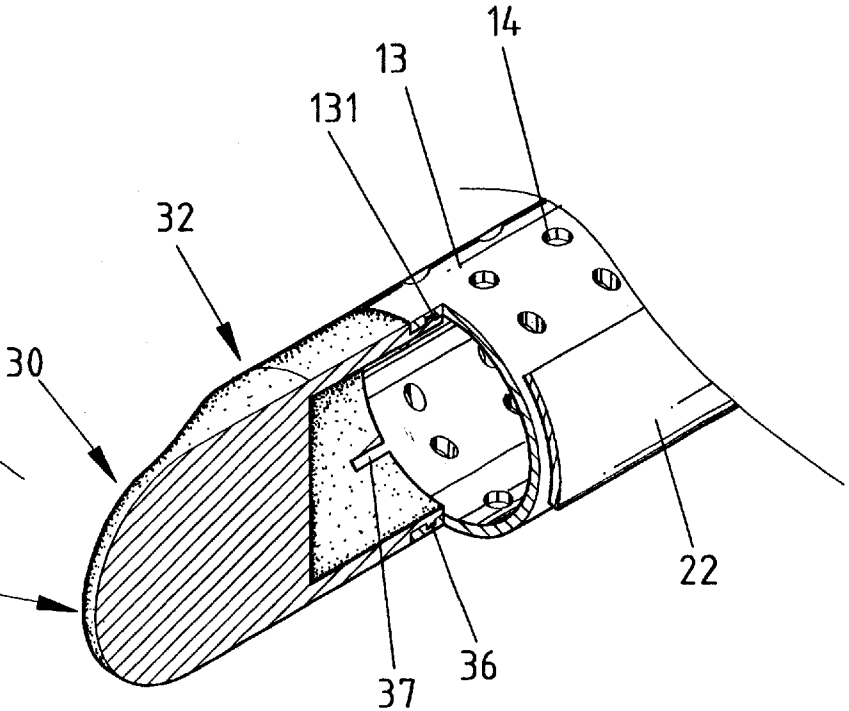
FIG. 4B is an enlarged perspective view, partly cutaway along plane 4—4 in FIG. 1, of the portion of the hand-held hair-curling appliance in FIG. 4A.
Figure 4A:
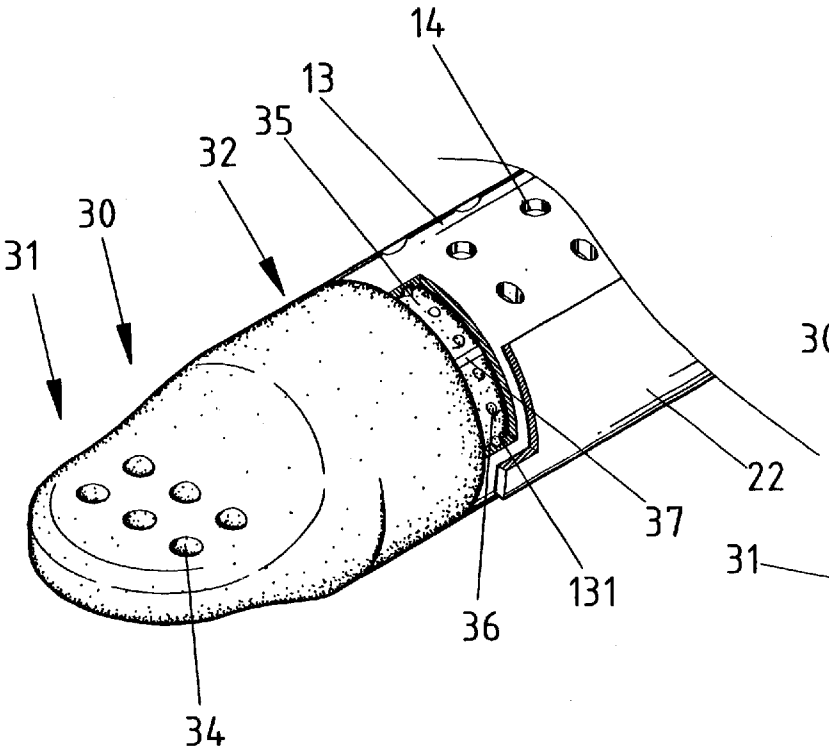
FIG. 4A is an enlarged perspective view, partly sectioned, of a portion of the hand-held hair-curling appliance.

A stabilizing member 30 is engaged with the end of the heat-transmitting portion 13 in a manner allowing relative rotational movement therebetween. In this embodiment, the stabilizing member 30 comprises a first end 31 having an anti-slip section 34 and a second end 32 having an engaging portion 35. Formed on an outer periphery of the engaging portion 35 are plural protrusions 36 that are engaged in the engaging groove 131 of the heat-transmitting portion 13, thereby allowing relative rotational movement between the heat-transmitting portion 13 and the stabilizing member 30, best shown in FIGS. 4A and 4B. Transverse slits 37 are defined in the engaging portion 35 to provide the stabilizing member 30 with flexibility.

Figure 5:
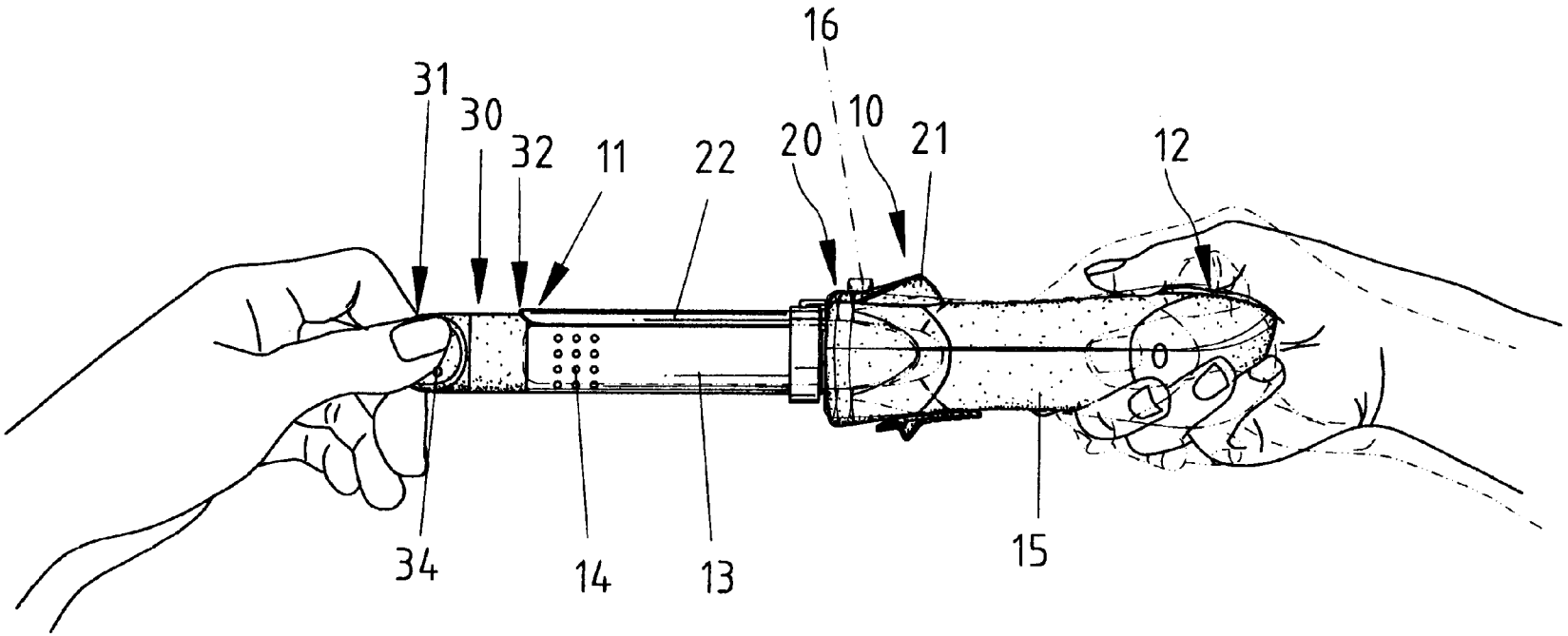
FIG. 5 is a side view illustrating operation of the hand-held hair-curling appliance.
Figure 6:
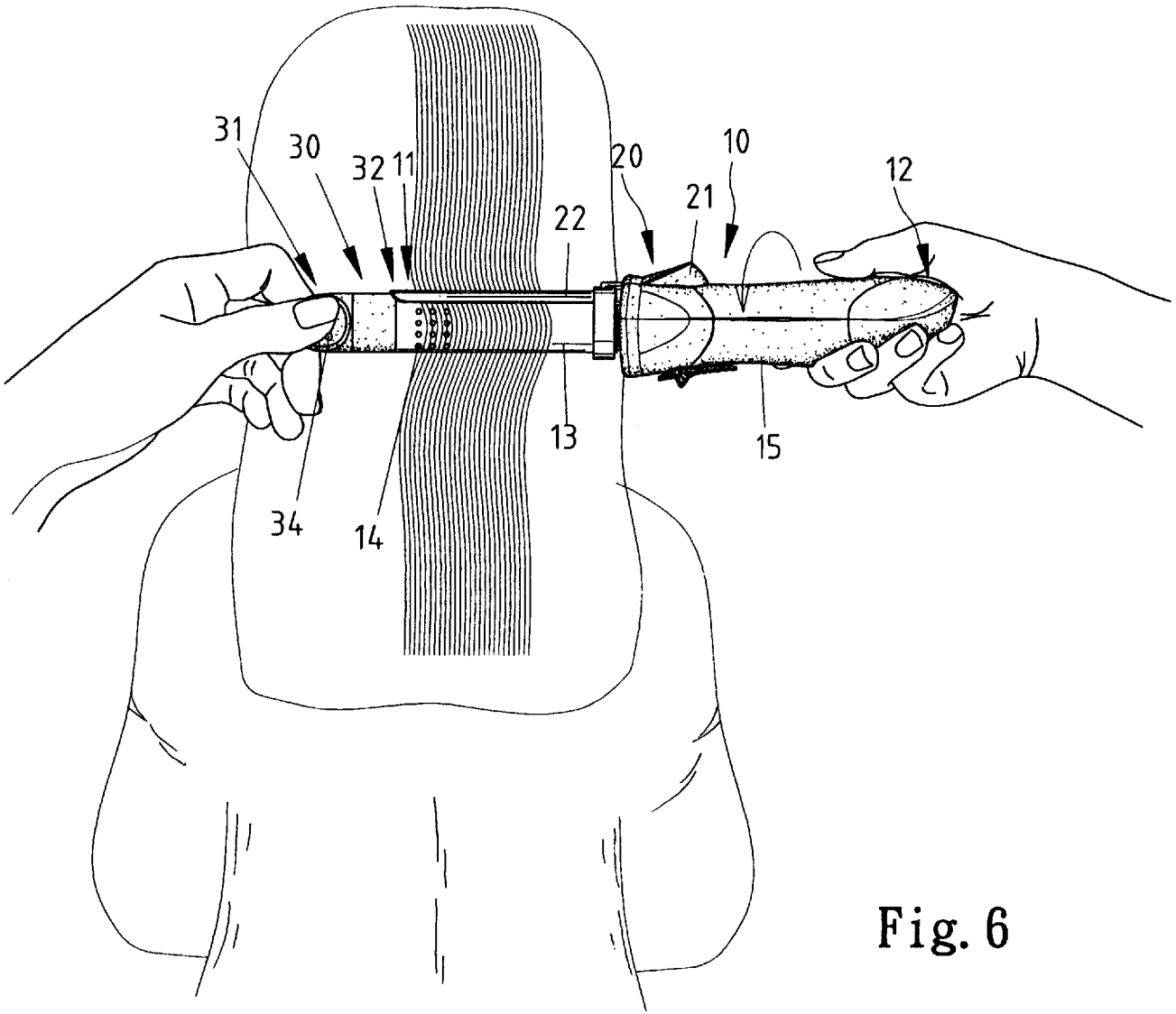
FIGS. 6 and 7 illustrate use of the hand-held hair-curling appliance.
Figure 7:
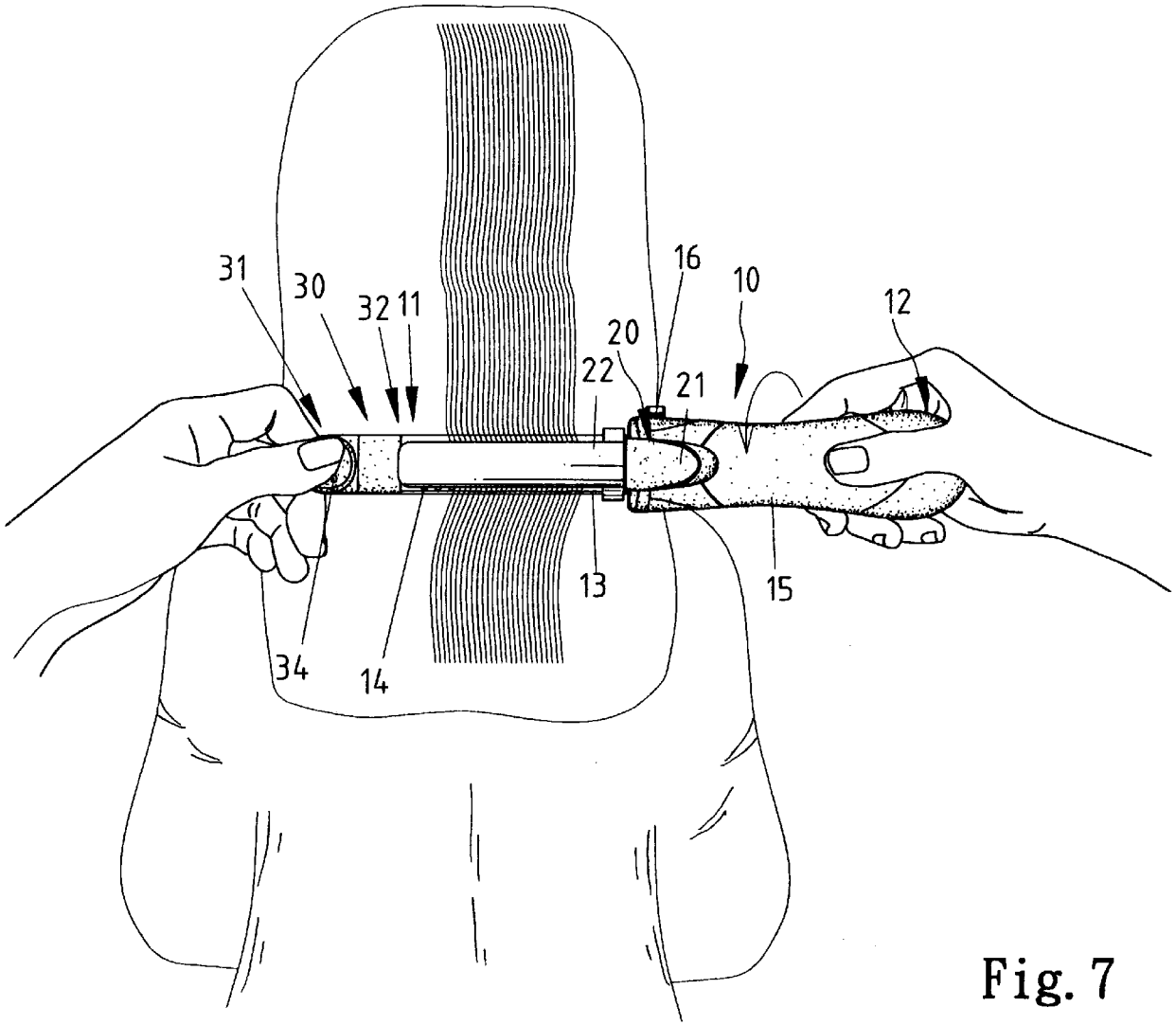

Referring to FIG. 5, the operator may grip the grip portion 15 of the heater 10 with one hand and grip the anti-slip section 34 of the first end 31 of the stabilizing member 30 with the other hand. The hand 6ripping the grip portion 15 of the heater 10 may be turned relative to the other hand. Referring to FIGS. 6 and 7, when in use, the hair is clamped between the heat-transmitting portion 13 and the hair-clamping member 20. The hair-curling appliance is then moved downward by both hands of the operator. In addition, the heater 10 is turned relative to the stabilizing member 30 during the downward movement of the hair-curling appliance while the stabilizing member 30 is not turned. Thus, a longitudinal axis of the heater 10 is kept parallel to a fixed axis, e.g., a horizontal axis, such that deviation of the heater 10 is prevented. This owes to the relative rotational movement between the heater 10 and the stabilizing member 30. Thus, the hair of another person is kept in intimate contact with the heat-transmitting portion 13 and thus curled to a required hairstyle after the hair-curling appliance is rolled downward, resulting in a satisfactory hairstyle.

Figure 8:
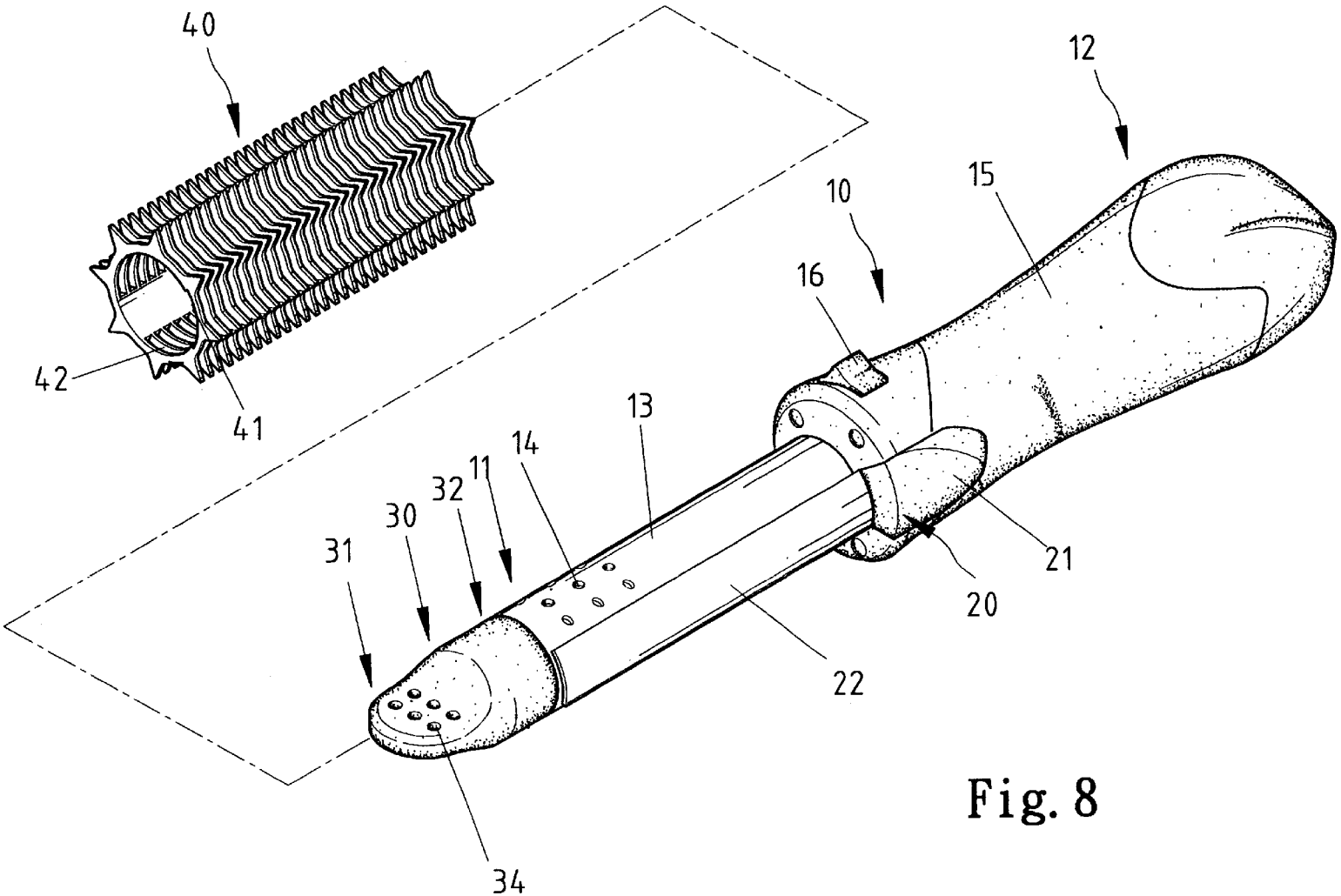
FIG. 8 is an exploded perspective view illustrating a further use of the hand-held hair-curling appliance in accordance with the present invention.

FIG. 8 illustrates a further use of the hair-curling appliance in accordance with the present invention, wherein a hair roller 40 is mounted around the heat-transmitting portion 13. The hair roller 40 comprises plural rows of teeth 41 and plural openings 42. The hair roller 40 may be optionally mounted to the heater 10 according to need.

Figure 9:
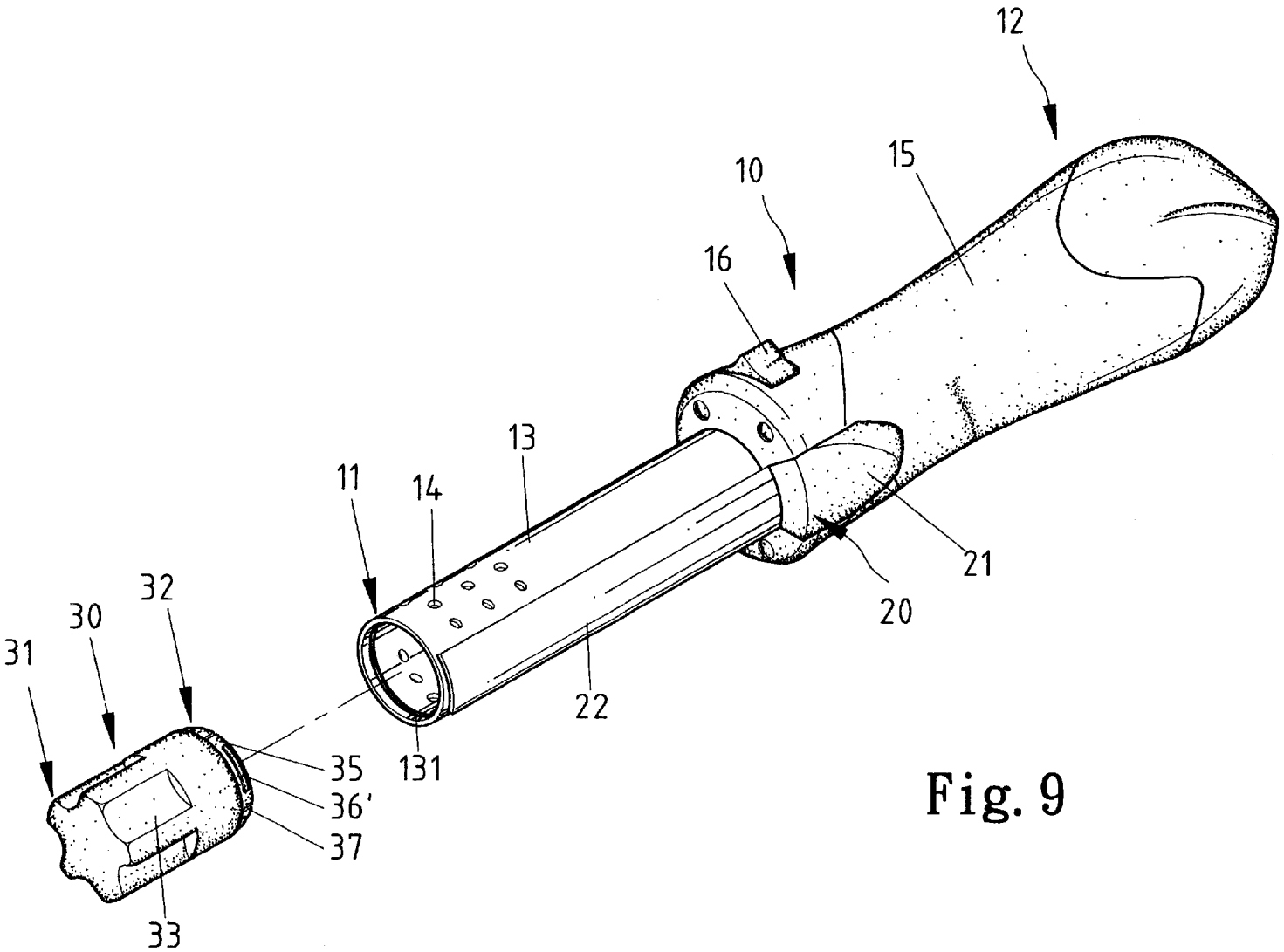
FIG. 9 is a perspective view, partly exploded, of a modified embodiment of the hand-held hair-curling appliance in accordance with the present invention.

FIG. 9 illustrates a modified embodiment of the hand-held hair-curling appliance in accordance with the present invention, wherein the first end 31 of the stabilizing member 30 is configured to provide an anti-slip section in another form 33. In addition, the protrusions 36 in the embodiment of the first embodiment is replaced by elongated strips 36' without adversely affecting the relative rotational movement between the stabilizing member 30 and the heat-transmitting portion 13.

Although the invention has been explained in relation to its preferred embodiment, it is to be understood that many other possible modifications and variations can be made without departing from the scope of the invention as hereinafter claimed.

What is claimed is:

1. A hand-held hair-curling appliance comprising:

a heater comprising a first end adapted to be gripped by a hand of an operator and a second end, a heat-transmitting portion being provided on the second end of the heater; and a stabilizing member engaged with the heat-transmitting portion of the heater such that the heat-transmitting portion is rotatable relative to the stabilizing member, the stabilizing member being adapted to be held by another hand of the operator, wherein the stabilizing member comprises a first end and a second end, the first end of the stabilizing member having an anti-slip section to be gripped by said another hand of the operator, the heat-transmitting portion of the heater being rotatably engaged with the second end of the stabilizing member.

2. The hand-held hair-curling appliance as claimed in claim 1, wherein the heat-transmitting portion of the heater is made of material that has a high conducting efficiency, the heat-transmitting portion further including plural holes to provide a high conducting efficiency when transmitting heat from the heat-transmitting portion to outside.

3. The hand-held hair-curling appliance as claimed in claim 1, wherein the first end of the heater comprises a grip portion that is configured ergonomically.

4. The hand-held hair-curling appliance as claimed in claim 1, wherein the heat-transmitting portion is heated by electricity.

5. The hand-held hair-curling appliance as claimed in claim 1, wherein the heat-transmitting portion is heated by means of burning gas.

6. The hand-held hair-curling appliance as claimed in claim 3, wherein the heater further comprises a clamping member having a first end, a second end, and an intermediate portion pivotally mounted to the grip portion, the first end of the clamping member being located proximal to the heat-transmitting portion when in use, wherein when the second end of the clamping member is pressed, the first end of the clamping member is moved away from the heat-transmitting portion.

7. The hand-held hair-curling appliance as claimed in claim 1, wherein the heat-transmitting portion of the heater comprises a cylindrical end having an annular engaging groove formed in an inner periphery of the cylindrical end, the second end of the stabilizing member comprises a cylindrical engaging portion received within the cylindrical end of the heat-transmitting portion and including plural protrusions on an outer periphery of the cylindrical engaging portion for rotatable engagement with the engaging groove.

8. The hand-held hair-curling appliance as claimed in claim 1, wherein the heat-transmitting portion of the heater comprises a cylindrical end having an annular engaging groove formed in an inner periphery of the cylindrical end, the second end of the stabilizing member comprises a cylindrical engaging portion received within the cylindrical end of the heat-transmitting portion and including plural strips on an outer periphery of the cylindrical engaging portion for rotatable engagement with the engaging groove.

9. The hand-held hair-curling appliance as claimed in claim 7, wherein the second end of the stabilizing member comprises plural transverse slits.

10. The hand-held hair-curling appliance as claimed in claim 8, wherein the second end of the stabilizing member comprises plural transverse slits.

11. The hand-held hair-curling appliance as claimed in claim 1, wherein the heater held by said hand of the operator is turned when the hand-held hair-curling appliance is used on another person's hair and moved downward, while the stabilizing member is not turned when the hand-held hair-curling appliance is moved downward, thereby keeping a longitudinal axis of the heater parallel to a fixed axis and thus preventing deviation of the heater during downward movement of the hand-held hair-curling appliance.

12. The hand-held hair-curling appliance as claimed in claim 7, with the anti-slip section formed by a noncylindrical portion extending from the cylindrical engaging portion, with the noncylindrical portion including raised tabs.

13. The hand-held hair-curling appliance as claimed in claim 8, with the anti-slip section being configured as a cylindrical portion having axially extending grooves in an outer periphery of the cylindrical portion.

14. The hand-held hair-curling appliance as claimed in claim 1, with the anti-slip section being configured as a noncylindrical portion, with the noncylindrical portion including raised tabs.

15. The hand-held hair-curling appliance as claimed in claim 1, with the anti-slip section being configured as a cylindrical portion having axially extending grooves in an outer periphery of the cylindrical portion.

* * * * *